United States Patent [19]

Holcomb

[11] 4,380,185

[45] Apr. 19, 1983

[54] TALKING METRONOME

[75] Inventor: Gayle Holcomb, Frankfort, Ky.

[73] Assignee: V-T Rhythms, Inc., Frankfort, Ky.

[21] Appl. No.: 321,627

[22] Filed: Nov. 16, 1981

[51] Int. Cl.[3] ..... G10F 1/00

[52] U.S. Cl. ..... 84/1.03; 84/DIG. 12; 84/470 R; 84/484; 179/1 SM

[58] Field of Search ..... 84/1.03, 470 R, 484, 84/DIG. 12; 368/63; 179/1 SA, 1 SG, 1 SM

[56] References Cited

U.S. PATENT DOCUMENTS 4,287,584 9/1981 Tanimoto et al. ..... 368/63

FOREIGN PATENT DOCUMENTS 7932101 7/1981 France ..... 84/484

*Primary Examiner*—J. V. Truhe
*Assistant Examiner*—Forester W. Isen

[57] ABSTRACT

A talking metronome is disclosed which is programmable to generate a human voice pattern of a sequence of numbers at a selected tempo (mm) and time signature (cadence) at one or more beat patterns. The time signatures are produced from quarter, eighth and sixteenth note beat patterns and all other varied combinations of beat patterns known to music. The voice pattern in the preferred embodiment is generated by synthesized speech.

12 Claims, 2 Drawing Figures

TALKING METRONOME

BACKGROUND OF THE INVENTION

1. Field of the Invention

The invention relates to apparatus for teaching musicians how to play music at selected tempos, time signatures and beat patterns.

2. Description of the Prior Art

Mechanical metronomes have been known for many years. These devices have a spring driven wand which produces an audible click upon the completion of each stroke of the wand. The tempo of the audible click is adjusted by varying the position of a weight located on the wand in accordance with a calibrated scale.

Electronic metronomes have been developed which produce repetitive non-voice sounds at selectable tempos, time signatures and beat patterns. Examples of this type of electronic metronome are disclosed in U.S. Pat. Nos. 4,014,167, 4,193,257, 4,204,400, and 4,193,257. An additional example of an electronic metronome is disclosed in U.S. Pat. No. 4,218,874.

U.S. Pat. No. 4,213,372 discloses a music teaching apparatus which is programmable to produce selected pitches. The pitches may be synthesized by a frequency synthesizer or voice synthesizer.

Semiconductor chips are currently commercially available for producing synthesized voice patterns with either standard or specialized vocabularies.

Music teachers have taught music students how to follow tempo, time signature and beat patterns by repeating a sequence of numbers at a desired tempo, time signature and beat pattern. Music teachers have recognized that a voice pattern of numbers repeated at the desired tempo, time signature and beat pattern often has enabled a student to play a piece of music at the desired tempo, time signature and beat pattern when a non-voice pattern such as that produced by a conventional metronome or electronic metronome has failed to help the student.

SUMMARY OF THE INVENTION

The inventor has observed during his professional experience of teaching music that a conventional metronome, which produces a periodic non-voice sound pattern calibrated in beats per minute, is not often useful for teaching beginning music students to learn to play at a desired tempo, time signature beat pattern which is conventionally indicated on sheet music. The beginning student typically finds it difficult or impossible to listen to the sound patterns produced by a conventional metronome as an aid to playing music at a desired tempo, time signature and beat pattern. It may be that the inability of music students to successfully use a metronome as an aid in playing music at a selected tempo, time signature and beat pattern stems from the lack of training of beginning music students to carefully listen to the metronome or a feeling of nervousness or pressure consequent from requesting the student to carefully listen to a non-voice pattern and to play along with it. It is for this reason that many music teachers discourage their beginning students from purchasing metronomes because they realize that they will be of little practical use and are therefore a non-productive expense in learning to play music.

A metronome in accordance with the present invention includes a control for selecting a tempo at which human voice patterns will be produced, the selected tempo being variable between a minimum and a maximum frequency; a control for selecting a time signature and beat pattern at which the human voice pattern will be reproduced and means responsive to the control for selecting a tempo and the control for selecting a time signature and beat pattern for producing a human voice pattern comprised of a sequence of successive numbers enunciated at the selected tempo and signature, the frequency of enunciation of the successive numbers per measure of the selected time signature being equal to the selected tempo and the enunciated successive numbers per measure being a function of the selected time signature.

DESCRIPTION OF THE PREFERRED EMBODIMENT

Figure 1:
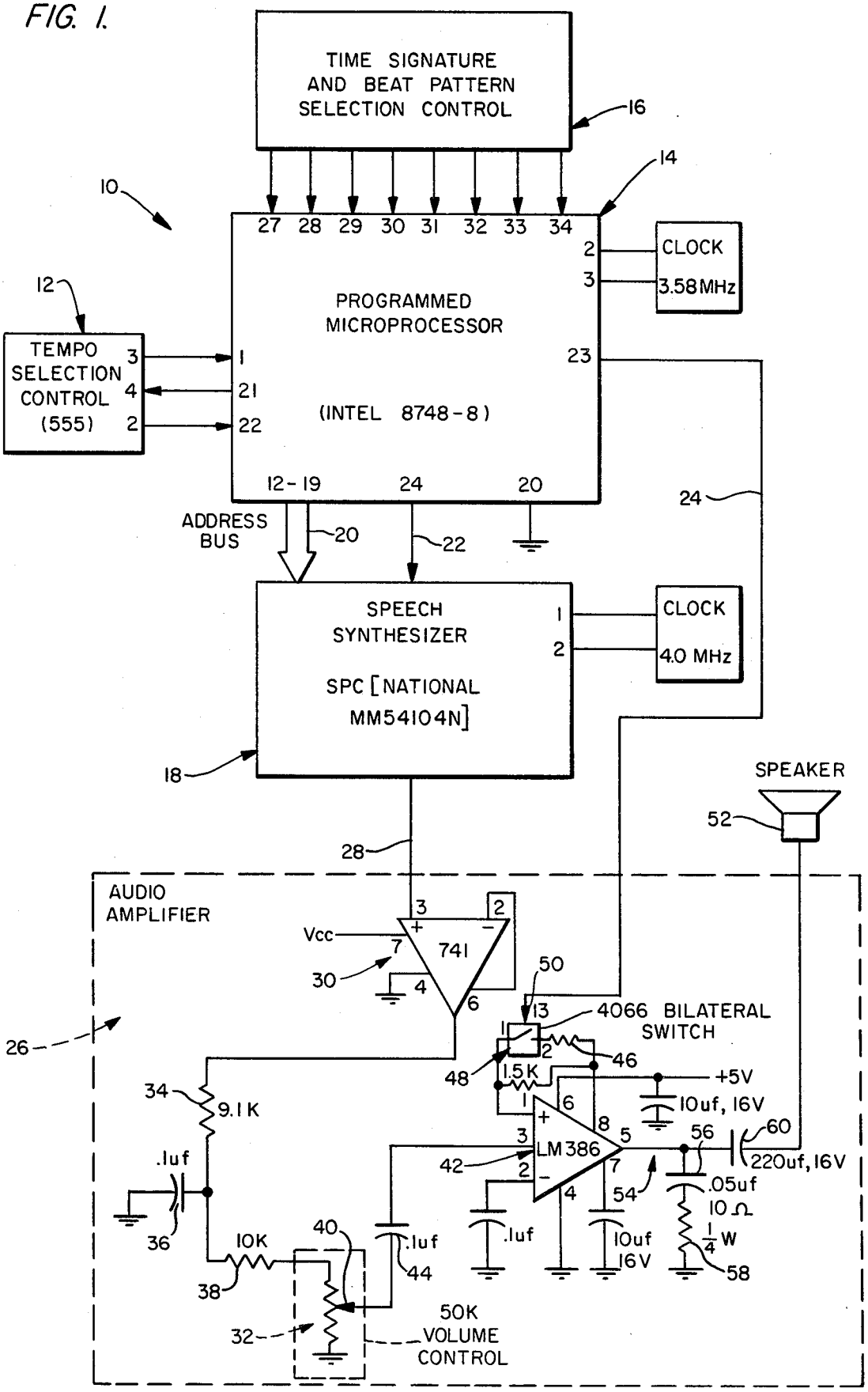
FIG. 1 is a system schematic of a music teaching apparatus in accordance with the invention.

FIG. 1 illustrates a schematic of a music teaching apparatus 10 in accordance with the invention. The part number for the preferred integrated circuit for implementing each of the functions performed within the labelled blocks of the schematic diagram of FIG. 1 is indicated in parentheses and the connection to each of the pins of the integrated circuit are identified by a number which appears within the functionally labeled rectangular box. The system has three main control functions, tempo, time signature and beat pattern, and volume, which produce a synthesized speech pattern that is effective in instructing beginning students to learn to follow tempo, time signature and beat pattern. The selection of the desired tempo, in beats per minute, is made by setting tempo selection control 12. The tempo selection control 12 produces a pulse train at a frequency corresponding to the desired tempo. The tempo selection control 12 is preferably comprised of a potentiometer which varies the RC time constant of a monostable multivibrator to produce pulses of a time duration which is a function of the RC time constant at a frequency corresponding to the desired tempo. The range of frequency of pulses produced by the tempo selection control 12, is variable between a minimum and maximum which is chosen to correspond to those tempos which are commonly encountered in music. The output signal of the tempo selection control 12 is coupled to a programmed microprocessor 14. The function of the tempo selection control 12 in the operation of the microprocessor 14 is described infra in conjunction with the flow chart of FIG. 2. The desired combination of time signature and beat pattern is selected by setting time signature selection and beat pattern control 16 which may be a multi-position switch with each position corresponding to a desired time combination signature and beat pattern. In the preferred form of the invention, there are eight distinct combinations of time signature and beat pattern which may be chosen by positioning of time signature selection control 16. The preferred combinations of time signature and beat pattern are 2/4 time with quarter notes, 2/4 time with eighth notes, 2/4 time with sixteenth notes, $\frac{3}{4}$ time with quarter notes, $\frac{3}{4}$ time with eighth notes, 4/4 time with quarter notes, 4/4 time with eighth notes and 6/8 time with eighth notes. The actual human voice pattern which is enunciated with each measure of each selected time combination of time signature and beat pattern is described infra. The microprocessor preferably has an internal memory which is an EPROM which is inter alia used to store a table of addresses for identifying the addresses of the sequence of words stored within the dictionary of words of speech synthesizer 18 which are to be used to synthesize the human voice pattern of the combinations of time signatures and beat patterns selected by time signature and beat pattern selection control 16. The information content which is stored in the table in the EPROM is described infra. The speech synthesizer may be a group of integrated circuits which are commercially available and which have either a standard dictionary of words or a special purpose dictionary of words which may be special ordered as an integrated circuit especially designed to synthesize speech patterns from the special dictionary. The programmed microprocessor 14 controls the synthesis of each word from the speech synthesizer 18 by producing an output of the word's address on bus 20 of the location in the dictionary of the speech synthesizer 18. The synthesis of each word by the speech synthesizer 18 is initiated after the outputting of the address on bus 20 when a low level signal is produced by the programmed microprocessor on line 22. The microprocessor 14 also functions to produce a series of high level pulses on line 24 which boost the gain on the audio amplifier 26 to provide higher volume emphasis on selected words within the synthesized speech patterns produced by the speech synthesizer 18. The synthesized speech pattern 18 is produced on output line 28 which is coupled to the audio amplifier 26. The audio amplifier 26 has a first amplification stage 30 which has an output coupled to a potentiometric volume control 32 by resistor 34, that is coupled to ground by capacitator 36, and resistor 38. The wiper 40 of the potentiometric volume control 32 is coupled to the input of a second amplification stage 42 by a capacitator 44. The gain of the second amplification stage may be varied by the selective coupling of feedback resistance 46 to the input by the closure of bilateral switch 48 upon the application of a high level signal on line 24 to the control terminal 50. The time signatures with eighth notes are comprised of a sequence of enunciated numbers which are individually separated by the word "and" which is enunciated at the frequency of the selected tempo. The time signature with sixteenth notes has a sequence of enunciated numbers which are individually separated by the sequence "e and a" which is enunciated at the frequency of the selected tempo.

The EPROM of the microprocessor 14 includes a table of groups of addresses in which the number of groups are equal to the number of combinations of time signatures and beat patterns which may be selected. Each group of addresses is equal in length and is comprised of a number of addresses within the dictionary of speech synthesizer 18 which are equal to the total number of enunciated words and sounds within a measure of the selected combination of time signature and beat pattern plus one or more additional dummy addresses to complete each table. The one or more dummy addresses indicate that the end of a measure has been reached. An example of a table of addresses stored in the microprocessor 14 EPROM for 2/4 time with sixteenth notes is set forth below in the table.

TABLE OF ADDRESSES FOR 2/4 TIME WITH SIXTEENTH NOTES

| Enunciated Speech | Relative Table Address |
|---|---|
| One | 1 |
| E | 2 |
| And | 3 |
| A | 4 |
| Two | 5 |
| E | 6 |
| And | 7 |
| A | 8 |
| No speech enunciation Signals end of measure | 9 |

The encoding of which words are to receive audio emphasis may be accomplished by the programming of a one in an unused bit position within the address bit positions which are available for communicating between the programmed microprocessor 14 and the speech synthesizer 18. The detection of a one in the unused bit position of an address in the table of addresses is used in the microprocessor program to signal when to produce the one of the series of pulses on line 24 which boost the gain of the audio amplifier 26. The end of a measure within each time signature is signalled by the detection of the unique word which appears at the end of a measure. In the table of addresses for 2/4 time with sixteenth notes supra, the nine address position performs this result. The enunciation of a word within a measure of any selected combination of a signature and beat pattern is initiated by the microprocessor control program by sequentially outputting the addresses of each word from the microprocessor 14 on the address bus 20 to the speech synthesizer 18. followed by the outputting of a pulse on line 22 which starts the actual synthesis of the word.

The invention has the capability of speeding up the enunciation of each word within a measure as the tempo is increased for a given time combination of signature and beat pattern. The simplest form of speech synthesis which is used with the invention has a constant time base for enunciating each particular word independent of the tempo. This form of speech synthesis has the disadvantage that fast tempos do not sound natural because the duration of each enunciated word sounds too long for the tempo. When only one duration of time base is used, the upper limit of the tempo is reached when the successive words to be enunciated within a measure do not have sufficient separation to prevent the words from running together. To produce a voice synthesis which sounds natural for widely varying tempos, the invention uses different duration time bases for enunciating words which vary inversely with the chosen tempo. Instead of one table of addresses for each measure, such as that set forth in the table above, two or more tables of addresses may be used, the first table being assigned to the enunciation of words at the slowest range of tempos, and each additional table being used to decrease the enunciation time of the words within the measure. The number of tables to be used in the voice synthesis of each measure of a given combination of a time signature and beat pattern is purely a matter of choice. For example, when multiple address tables are used, it may be desirable for a given word within a measure to be enunciated with half the time base for the highest range of tempos rather than the time base used to enunciate the same word at the slowest range of tempos.

Figure 2:
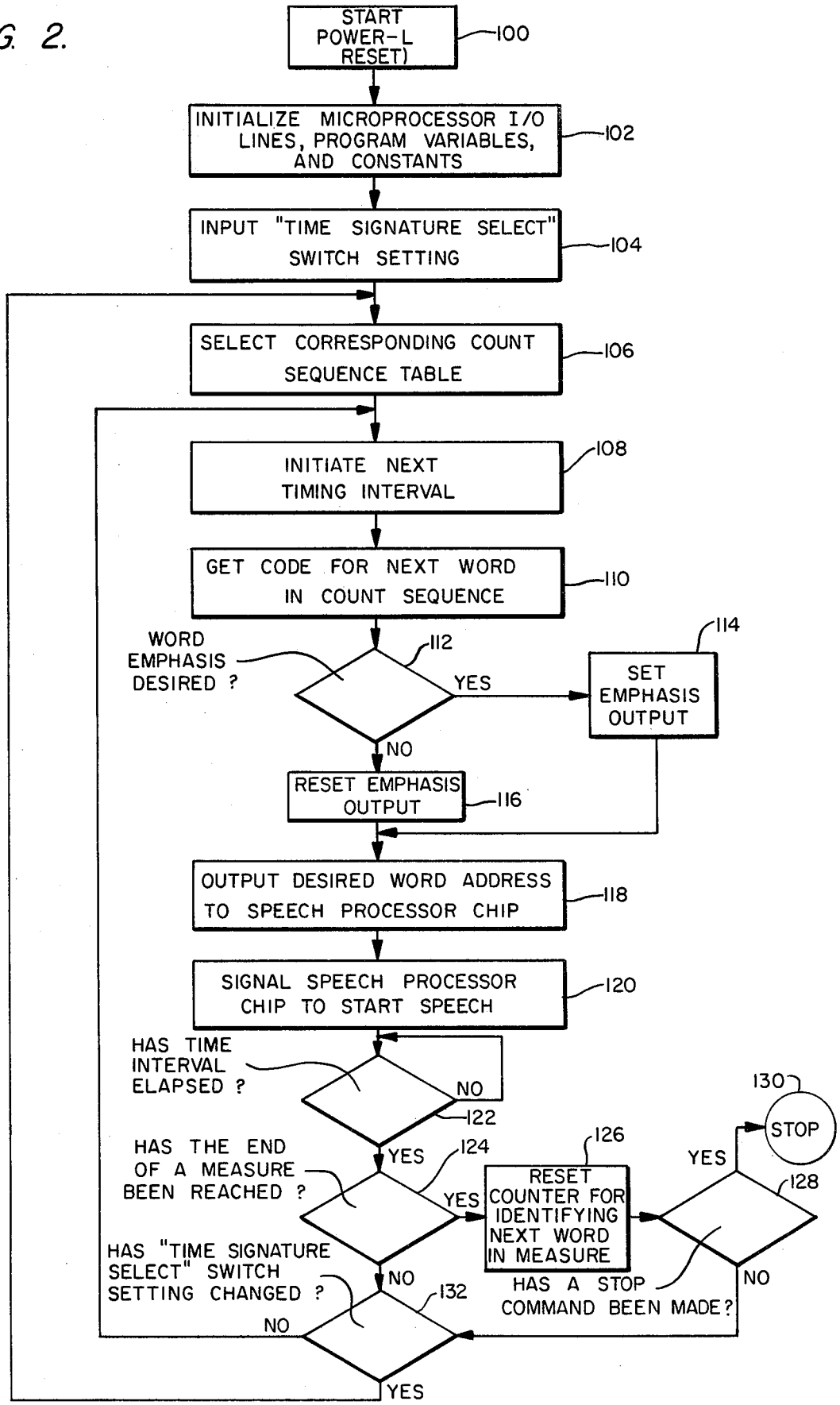
FIG. 2 is a flow chart of a computer program for the microprocessor illustrated in FIG. 1.

FIG. 2 illustrates a flow chart of a computer program used by the microprocessor 14 for controlling the voice synthesis of any one of a plurality of combinations of time signatures and beat patterns at a selected tempo. The program starts at point 100 where the power is turned on and all circuits are reset. The program next proceeds to block 102 where the microprocessor, input-/output lines, program variables and constants are initialized. The program next proceeds to block 104 where the selected combination of time signature and beat pattern is read from the time signature and beat pattern selection control 16 which has been positioned by the operator. The preferred choices of time signature and beat pattern have been described supra but it should be clearly understood that the invention is applicable to producing any desired group of time signatures and beat patterns at any selected tempo. The program next proceeds to block 106 where the selected combination of time signature and beat pattern is used to identify the group of addresses within the EPROM of the microprocessor 14 which are to be used to synthesize the voice pattern of a measure of that selected combination of time signature and beat pattern. The table of addresses discussed supra would be used in the case where 2/4 time is selected with the sixteenth notes when the time base is independent of tempo. It should be clearly understood that a group of addresses for each combination of time signature and beat pattern is read from the EPROM of the microprocessor for synthesizing that particular combination of time signature and beat pattern. Moreover, when the time base is dependent upon the tempo, each selected combination of time signature and beat pattern will have as many tables associated with it as there are time bases. The program next proceeds to block 108 where the monostable multivibrator within the tempo selection control 12 is triggered and the time interval during which the monostable multivibrator is in its high state is begun. The program next proceeds to block 110 where the number of the word within a measure which is next to be synthesized is obtained by reading the count of an internal counter within the microprocessor 14. In the case of each combination of time signature and beat pattern, the first word is assigned the count of one and each successive word within a measure is assigned a successive number until the measure is completed. The count functions as the mechanism for choosing the address within the group of addresses used for synthesizing the next word within a measure of the selected combination of time signature and beat pattern to be synthesized by the voice synthesizer 18. The program next proceeds to decision point 112 where a determination is made if the audio gain of the audio amplifier 26 is to be increased for the enunciation of that word by closing the bilateral switch 48. As described supra, the determination is made by checking an unused address bit to determine if it has been set high. The preferred emphasis sequence to be used is identified by the underscoring of selected words within the table of measures of the preferred combination of time signatures and beat patterns which has been described supra. If the next word to be synthesized is not to be emphasized, the program proceeds to block 116 where the bilateral switch 48 is reset to insure that the audio gain of the audio amplifier 26 will not emphasize the next word. The program next proceeds to block 118 where the address of the next word to be voice synthesized, which has been obtained from the address table, is outputted on the bus 20 of the microprocessor 14 to the voice synthesizer 18. The program next proceeds to block 120 where an output signal is placed on line 22 of the microprocessor for the purpose of instructing the speech synthesizer 18 to start the voice synthesis of the word. The program next proceeds to decision point 122 where the program loops until one beat of the chosen tempo is completed. The completion of one beat is signalled by the tempo selection control 12 changing from its high state to a low state. As has been described supra, the duration of the high state of the monostable multivibrator within the tempo selection control 12 is a function of the RC time constant which is determined by the adjustment of the tempo selection control 12. The program next proceeds to decision point 124 where a determination is made as to whether the end of a measure has been reached in the group of addresses for the desired time signature. As has been discussed supra, in the case of 2/4 time with sixteenth notes, the ninth address position within the table signals that the end of a measure has been reached. If the answer is yes, the program proceeds to block 126 where the internal counter, which is read at block 110 to obtain the address of the next word to be voice synthesized within the group of addresses for the selected combination of time signature and beat pattern is set to 1 to prepare the voice synthesizer 18 to repeat the enunciation of the measure. The program proceeds to decision point 128 where a determination is made as to whether a stop command has been made. A stop command may be signalled by turning off the power or the pushing of a stop command control which may be provided on the front panel of the housing which contains the invention. If a stop command has been made, the program enters a stop phase at 130. If the answer is no, the program proceeds to decision point 132 where a determination is made as to whether the same time signature and beat pattern is still being specified by the time signature and beat pattern selection control 16. If there is no change in the time signature and beat pattern selection control 16, the program loops back to block 108 where a new time interval is begun by the tempo selection control 112. If there has been a change in the time selection control 16, the program loops to block 106 to obtain the table of a newly selected time signature and beat pattern. If the end of a measure has not been detected at decision point 124, the program proceeds to decision point 132 which functions in the manner described above. The program will continue to produce synthesized speech at the selected time signature and tempo until manually stopped by turning off the power or pushing a stop button. Any adjustment in the selected tempo is immediately picked up at block 108 where the time interval is changed by the adjustment of the tempo control.

It should be clearly understood that the combination of time signature and beat patterns which have been specifically set forth supra are only representative of the combinations of time signatures and beat patterns which may be voice synthesized by the invention at a programmable tempo. Other examples without being limited thereto, are quarter and eighth note triplets and dotted quarter and eighth notes. Numerous other time signatures and beat patterns are apparent to skilled musicians. The invention may also be used for keeping rythm in exercise classes.

The invention has been described in terms of its preferred embodiment. However, it should be clearly understood that numerous modifications may be made thereto without departing from the scope of the invention as defined by the appended claims.

I claim:

1. A metronome comprising:

(a) means for selecting a tempo at which human voice patterns will be reproduced, the selected tempo being variable between a minimum and a maximum frequency;

(b) means for selecting a combination of time signature beat pattern at which the human voice patterns will be produced; and (c) means responsive to the means for selecting a tempo and the means for selecting a combination of time signature and beat pattern for producing a human voice pattern comprised of a sequence of successive numbers enunciated at the selected tempo and time signature and beat pattern, the frequency of enunciation of the successive numbers per measure of the selected time signature and beat pattern being equal to the selected tempo and the successive numbers enunciated per measure being a function of the selected time signature.

2. A metronome in accordance with claim 1, wherein the means for producing the human voice is a speech synthesizer.

3. A metronome in accordance with claim 2 wherein the selected time signature is chosen from 2/4 time, 3/4 time, 4/4 time and 6/8 time.

4. A metronome in accordance with claim 2 or 3 wherein the beat patterns are chosen from quarter notes, eighth notes and sixteenth notes.

5. A metronome in accordance with claim 4 wherein each pair of numbers of a measure which is enunciated with beat patterns of eighth notes is separated by the enunciation of the word "and" which is repeated at the frequency of the selected tempo.

6. A metronome in accordance with claim 4 wherein each pair of numbers of a measure is enunciated with beat patterns of sixteenth notes and is separated by the voice pattern "e and a" which is repeated at the frequency of the selected tempo.

7. A metronome in accordance with claim 5 wherein:

(a) a measure of 2/4 time with quarter notes is comprised of the human voice pattern "One, two"

(b) a measure of 2/4 time with eighth notes is comprised of the human voice pattern "one and two and";

(c) a measure of 2/4 time with sixteenth notes is comprised of the human voice pattern "one e and a two e and a";

(d) a measure of $\frac{3}{4}$ time with quarter notes is comprised of the human voice pattern "One, two, three";

(e) a measure of $\frac{3}{4}$ time with eighth notes is comprised of the human voice pattern "One and two and three and";

(f) a measure of 4/4 time with quarter notes is comprised of the human voice pattern "One, two, three, four";

(g) a measure of 4/4 time with eighth notes is comprised of the human voice pattern "One, and two, and three, and four, and"; and (h) a measure of 6/8 time with quarter notes is comprised of the human voice pattern of "One, two, three, four, five, six".

8. A metronome in accordance with claim 7 further comprising means for synthesizing selected numbers of a selected voice synthesized pattern at an increased audio level.

9. A metronome in accordance with claim 5 wherein each pair of numbers of a measure which is enunciated with a beat pattern of sixteenth notes is separated by the voice pattern "e and a" which is repeated at the frequency of the selected tempo.

10. A metronome in accordance with claim 1 or 2 wherein the time of duration for producing each human voice sound is a function of the selected tempo.

11. A metronome in accordance with claim 10 wherein the time of duration for producing each human voice sound is inversely proportional to the selected tempo.

12. A metronome in accordance with claim 10 wherein a plurality of time durations which get progressively shorter, are available for producing each known voice sound, the longest time duration being used for a range of tempos extending from the slowest tempo to a higher tempo, and each additional time duration being used for successively higher ranges of tempos.

* * * * *